United States Patent [19]

Perri et al.

[11] 4,081,041

[45] Mar. 28, 1978

[54] DUST-COLLECTING HEAD

[75] Inventors: Michael J. Perri; Glen A. Zumwalt, both of Green River, Wyo.

[73] Assignee: Stauffer Chemical Company of Wyoming, San Francisco, Calif.

[21] Appl. No.: 770,737

[22] Filed: Feb. 22, 1977

[51] Int. Cl.[2] ..... E21C 7/00

[52] U.S. Cl. ..... 175/209

[58] Field of Search ..... 175/209, 213, 211

[56] References Cited

U.S. PATENT DOCUMENTS

| | | | |
|---|---|---|---|
| 1,057,568 | 4/1913 | Mayer et al. | 175/211 |
| 1,972,846 | 9/1934 | Kelley | 175/209 |
| 2,590,958 | 4/1952 | Goodrich | 175/209 |
| 2,829,867 | 4/1958 | Brochetti | 175/209 |
| 2,832,567 | 4/1958 | Fletcher et al. | 175/209 |
| 3,924,696 | 12/1975 | Horlin et al. | 175/209 |

*Primary Examiner*—James A. Leppink
*Attorney, Agent, or Firm*—Daniel C. Block

[57] ABSTRACT

A system for collecting dust during drilling operations in a mine with a roof drill machine is described herein. The system consists of a mobile roof drilling machine having a conical shaped dust-collecting bowl adjacent to the surface being drilled. It is provided with annular space between the drill and the conical dust-collecting system to allow the drill to be injected into the roof of the mine. The system has a strong suction mechanism tangentially associated on each side of the dust-collecting system so as to provide a swirling motion of the falling dust particles.

4 Claims, 4 Drawing Figures

DUST-COLLECTING HEAD

BACKGROUND OF THE INVENTION

It is the current practice to support mine roofs by overhead bolts instead of props extending from the floor to the roof of the mine. The bolts are inserted into holes that have been drilled through the roofs. During the drilling of these holes and during each other such drilling operations, a great deal of particulate matter is formed resulting in heavy clouds of dust with all the well-known disadvantages.

Previous methods or systems employed for collecting this dust include separate dust bowls that work separately from the drilling mechanism and are placed adjacent the drilling site. Another such mechanism includes dust-collecting bowls with suctions on the bottoms thereof that catch the dust particles as they fall from the drilling site and are conveyed away. These methods, however, are very inefficient and require careful handling. However, these types of dust-collecting mechanisms have resulted in the operator being required to wear a safety mask because the dust cloud is so heavy. Illustrative of these types of dust-collecting mechanisms are shown in U.S. Pat. Nos. 1,057,568, 1,972,846, 2,590,958, 2,829,867, 2,832,567 and 3,924,696.

DETAILED DESCRIPTION OF THE INVENTION

Figure 1:
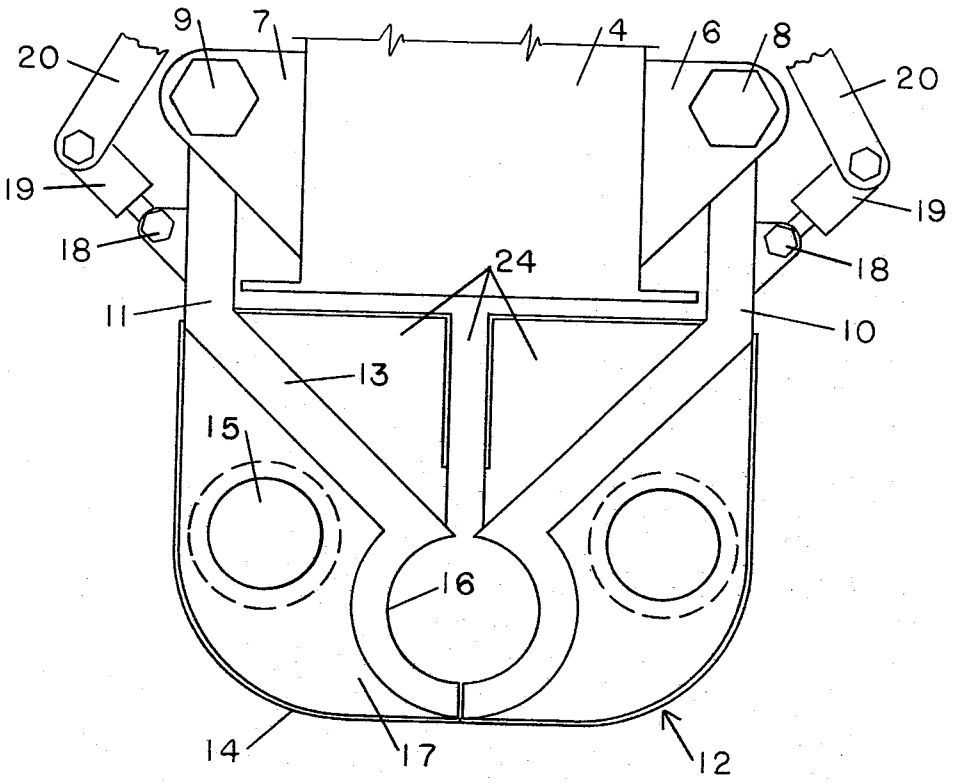
FIG. 1 is a top plan view of a prior art dust-collection system.

In order to more clearly understand the principles of the present invention, it will be compared in detail with the prior art devices. Thus, referring first to FIGS. 1 and 2 which illustrate prior art devices, the roof bolting device 1 consists of a pair of spaced-apart frame members 2 and 3 being connected at the upper end thereof with a cover plate 4. A chain member 5 is rotatively connected between members 2 and 3. The chain member 5 is connected at its lower end with a chuck member which is rotated by a motor. The chuck is adapted to receive a drill bit for drilling a hole in the roof of a mine. The chuck, of course, is connected to a mobile roof-drilling mechanism. Such a mechanism is generally illustrated in U.S. Pat. No. 2,832,567 referred to hereinabove.

Adjacent to the upper end of the device 1 but spaced downwardly therefrom is a pair of mounting wings 6 and 7 having pivot pins 8 and 9 extending therethrough pivotally connecting arms 10 and 11 thereto. Arms 10 and 11 are connected to a dust-collection device generally indicated at 12. Actually, as will be hereinafter described, the members 11 and 10 consist of an inner wall 13 of the collection device. The collection device 12 consists of two symmetrically positioned members consisting of an outer wall 14 and an inner wall 13 that extends upwardly to form a cup member. The inner wall 13 extends at an approximate 45° angle through the cup member and forms an opening 16 at the central portion thereof to receive the drill rod not shown.

The bottom wall 17 of the cup member 12 is provided with an opening 15 which is connected to a nipple 21 that is also connected to a hose 22 by clamp 23. The hose 22 is connected to a Y member, not shown, which is in turn connected to a single hose which conducts air to the bottom portion of the member 12 to provide a suction or negative pressure therein. Each half of the mechanism 12 is moved to its open-close position by a linkage system consisting of an arm 20 connected to a cylinder, not shown, which is pivotally connected to an arm 19 pivotally connected at 18 to arm member 11. The other side of mechanism 12 is similarly connected to the arm member and as illustrated.

As illustrated more clearly in FIG. 1, when the dust-collecting device 12 is in its closed or working position, there is provided a dead space indicated at 24 between each of the members 12 that is not in communication with the suction or negative pressure.

Figure 2:
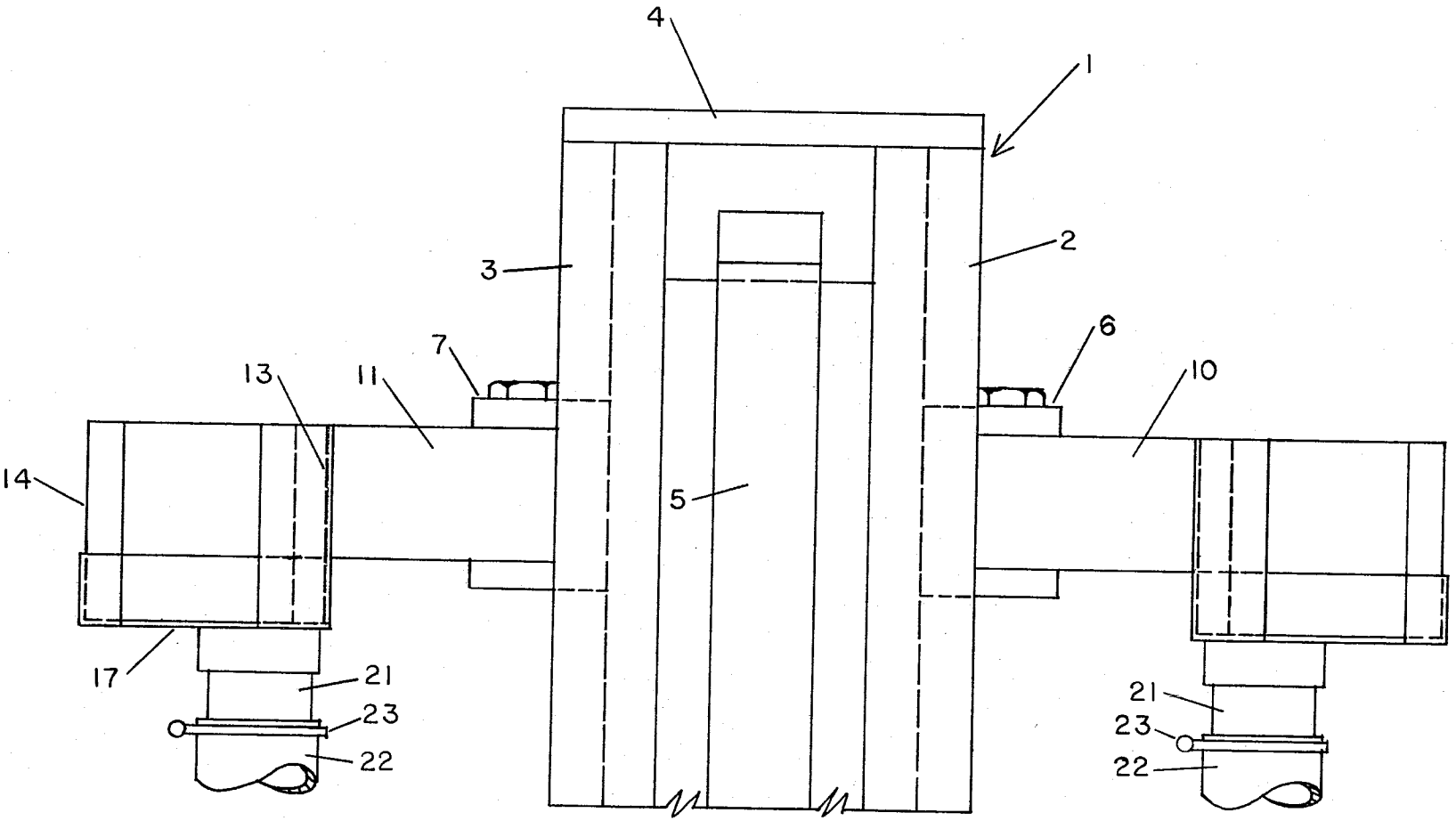
FIG. 2 is a side elevation of the dust-collection system of FIG. 1 but in an open position.

In operation of the mechanism illustrated in FIGS. 1 and 2, a mobile drill-roofing machine with a chuck is moved into position and a drill rod, not shown, is mounted in the chuck and extends through opening 16. As the roof bolt mechanism is rotated, it will drill a hole into the roof of the mine. As the drill progresses, the cuttings will fall by gravity downwardly and a porion thereof will be collected by the vacuum or suction device through opening 15 that extends through the bottom wall of the device 12. However, a substantial portion of the dust particles will also fall into that space indicated at 24 and fall to the ground. This, of course, causes a substantial amount of dust in the vicinity of the roof-bolting drilling operation. This high concentration of dust requires that the operator of the machine to wear a mask at all times for protection. Moreover, because the member 12 is spaced substantially below the upper end, the member 12 must be deactivated to allow the chuck and drill to reach its uppermost stroke. By deactivation is meant that member 12 must be opened up as illustrated in FIG. 2.

Figure 3:
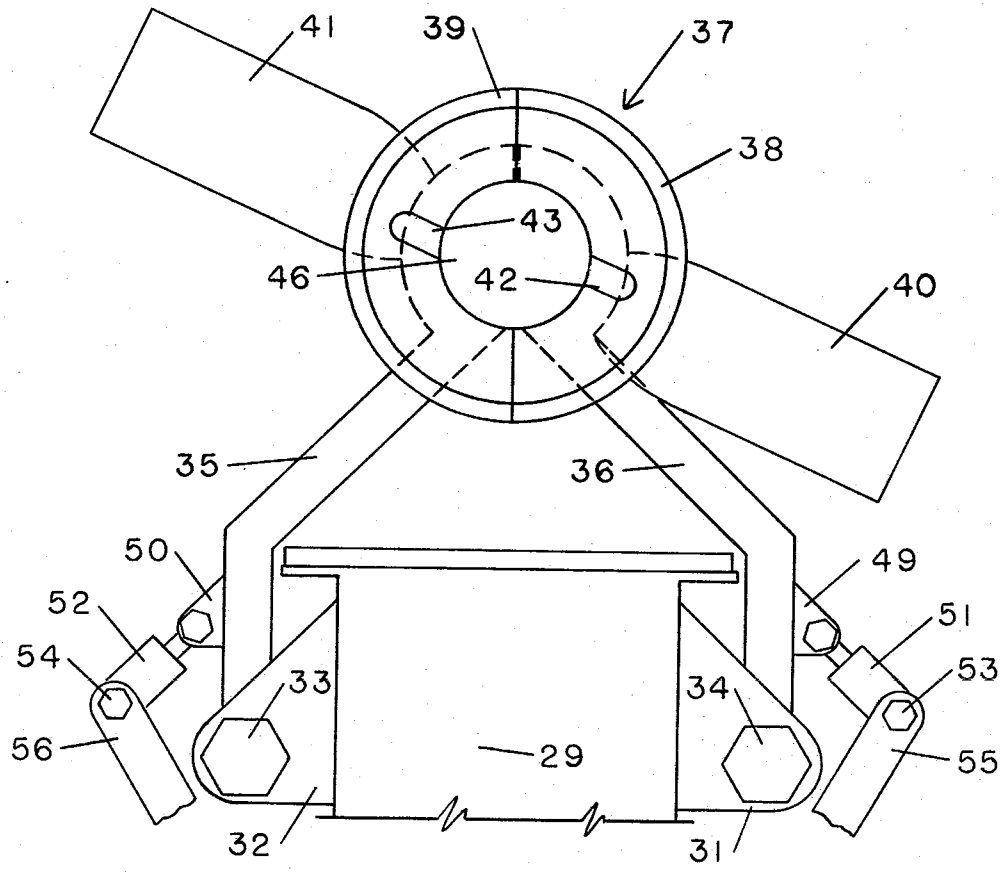
FIG. 3 is a top plan view of the dust-collection system embodying the principles of the present invention.
Figure 4:
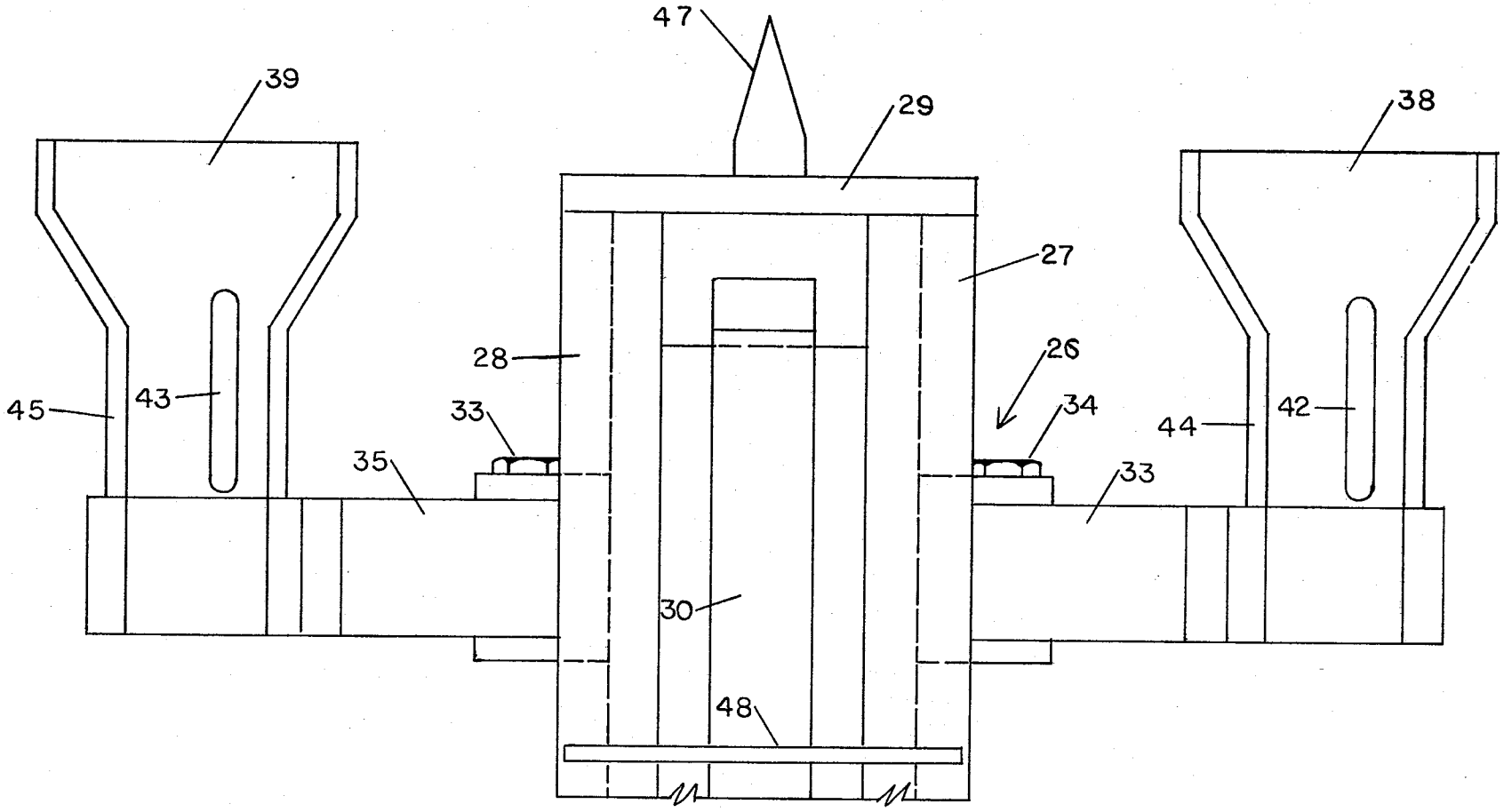
FIG. 4 is a side elevation of the dust-collection system of FIG. 3.

Referring now to FIGS. 3 and 4, the roof-bolting and dust-collecting machine is illustrated. As indicated, roof-bolting device 26 is provided with a pair of spaced-apart frame members 27 and 28 with a cover mechanism 29. On top of the cover mechanism 29 is provided an anchoring mechanism 47 for a purpose to be hereinafter described. The roof-bolting machine is similar to the roof-drill machine illustrated in U.S. Pat. No. 2,832,567. Mounted adjacent to the members 27 and 28, is a chain member 30 which rotates in a manner well known in the art.

Mounted adjacent the upper end 29 are a pair of mounting arms 31 and 32 which pivotally mount arms 35 and 36 at 33 and 34 thereto. The outer portions of arms 35 and 36 are rigidly mounted to a pair of dust-collecting members generally indicated at 37. The dust-collecting system indicated at 37 generally consists of two portions which are symmetrical with respect to each other. These members consist of an upper body portion 38 and 39 and a lower body porton 44 and 45. The lower body portions 44 and 45 are connected to the arm members 35 and 36 and are essentially cylindrical in design. The upper body portions 38 and 39 are integrally connected to the body portions 44 and 45 and extend upwardly and outwardly to form a funnel or cone shaped member.

As illustrated more clearly in FIG. 3, when the two members indicated at 38 and 39 are in a closed position, it forms an opening 46 to receive the drill rod going up into the roof to drill a hole therein. Also, each of the portions 38 and 39 are provided with openings indicated at 42 and 43. The openings 42 and 43 are connected to conduits 40 and 41. The conduits 40 and 41 are each connected to a motor to provide a vacuum thereto. It should be noted that the openings 42 and 43 that communicate with the inner portion of members 38 and 39 are not merely adjacent to each other but are on opposite sides of the center portion to form a tangential path into the inner portion of the dust-collecting device for a purpose to be hereinafter described.

The arm members 35 and 36 are rigidly connected to linkages indicated at 55 pivotally connected to mountings 49 and 50 which are in turn connected to arm linkages 51 and 52 pivotally connected at 53 and 54 to arm members 55 and 56 which are connected to air cylinders or other hydraulic means not shown which open and close the members 38 and 39.

In operation, the roof-bolting machine is mounted on a mobile drill mechanism as similarly shown in U.S. Pat. No. 2,832,567 and is pushed up into the roof wherein the mounting members 47 clearly hold the same in a rigid position. The drill rod is then placed into the chuck and then the mechanism is actuated to close the same and to form the position as indicated and shown in FIG. 3. It should be clearly noted at this point that there is essentially no dead space adjacent to the opening 46 wherein the drill rod extends therethrough. As the drill rod goes into the roofing portion, the debris and dust particles falling down therefrom are in fact swirled by the tangential vacuum mechanism extending into the open portion 46 as indicated at 42 and 43. Please note that the vacuum from conduit 40 and 41 do not play against each other but compliment each other by having the openings 42 and 43 egress to the interior portion thereof in a tangential direction. Additionally, the upper extension of members 38 and 39 is selected to be adjacent to member 47 so as to provide a minimum of space that can allow dust particles to escape. When the drill chuck goes to its uppermost position and the hole is complete, it will strike the bar 48 indicated in FIG. 4 and will automatically stop drilling. It has been found in practice that the use of the dust-collecting system of the present invention essentially collects all the dust particles falling from the holes being drilled through the roof of the mine.

Having described the principles of the present invention, it should be understood that modifications can be made without departing from the spirit of the invention.

What is claimed is:

1. In a roof drilling machine provided with a rotatable chuck adapted to receive a drill rod for drilling a hole into the roof of a mine and consisting of a pair of spaced-apart frame members having a chain connected to the chuck between said frame members and rotatable to move the rotating chuck upwardly during drilling operations; a dust-collecting system pivotally mounted adjacent the upper end of said spaced-apart supporting mechanism rotatable to the closed position around the drilling rod and to an open position away from the drilling rod; the improvement comprising a dust-collection system being symmetrical in nature and a conical shape to be fully enclosed around the drill rod during drilling operations and an opening on each side of said symmetrical members connected to a separate source of vacuum whereby the debris falling from the drilling site is removed through the openings.

2. The apparatus as set forth in claim 1 wherein the openings adjacent each side of said symmetrical members form a path that is in a tangential direction so as to provide a swirling motion for the debris falling from the drilling site.

3. The apparatus as set forth in claim 1 together with a stop bar adjacent the upper end thereof so as to stop the drilling chuck from further movement when the upper direction has been reached.

4. The apparatus as set forth in claim 1 wherein each portion of said dust-collecting system consists of a lower cylindrical body portion integrally connected to an upper body portion extending outwardly and upwardly thereform.

* * * * *